US008613606B2

(12) United States Patent
Katsura et al.

(10) Patent No.: US 8,613,606 B2
(45) Date of Patent: Dec. 24, 2013

(54) BELLOWS PUMP

(75) Inventors: Masayoshi Katsura, Sanda (JP); Atsushi Nakano, Sanda (JP); Tomohiro Adachi, Sanda (JP)

(73) Assignee: Nippon Pillar Packing Co., Ltd., Osaka-Shi (JP)

( * ) Notice: Subject to any disclaimer, the term of this patent is extended or adjusted under 35 U.S.C. 154(b) by 113 days.

(21) Appl. No.: 13/201,039

(22) PCT Filed: Feb. 2, 2010

(86) PCT No.: PCT/JP2010/051406

§ 371 (c)(1),
(2), (4) Date: Aug. 11, 2011

(87) PCT Pub. No.: WO2010/098176

PCT Pub. Date: Sep. 2, 2010

(65) Prior Publication Data

US 2011/0318207 A1 Dec. 29, 2011

(30) Foreign Application Priority Data

Feb. 24, 2009 (JP) ..... 2009-040673

(51) Int. Cl.

| | |
|---|---|
| ***F04B 43/00*** | (2006.01) |
| ***F01B 19/00*** | (2006.01) |
| ***F16J 3/04*** | (2006.01) |

(52) U.S. Cl.

USPC ..... 417/473; 92/37; 92/44; 92/47

(58) Field of Classification Search

USPC ..... 417/472, 473, 394, 412; 92/34, 37, 40, 92/41, 43, 44, 35, 36, 38, 39, 42, 45, 46, 92/47

See application file for complete search history.

(56) References Cited

U.S. PATENT DOCUMENTS

| | | | | |
|---|---|---|---|---|
| 2,418,614 | A * | 4/1947 | Annin | 73/302 |
| 2006/0165541 | A1 * | 7/2006 | Teshima | 417/472 |

FOREIGN PATENT DOCUMENTS

| | | |
|---|---|---|
| JP | 62-175281 | 11/1987 |
| JP | 63-38686 | 3/1988 |
| JP | 2-69081 | 5/1990 |
| JP | 3-102079 | 10/1991 |

* cited by examiner

*Primary Examiner* — Bryan Lettman
(74) *Attorney, Agent, or Firm* — Rankin, Hill & Clark LLP

(57) ABSTRACT

A bellows pump having a pump body including a suction path and a discharge path for a fluid and a bellows which is placed in a state where a basal end flange is airtightly fixed to the pump body to form a pump chamber with respect to the pump body. The bellows pump further comprises an actuation plate which is attached to a head portion of the bellows so as to cause the bellows to expand and contract with respect to the pump body. The bellows is further configured so that an airtight space is formed with between the actuation plate and a cup shape section formed in the head portion, such that a pressure rise can be absorbed and relaxed by contraction of the space portion caused by elastic film deformation of the thin head portion which faces the space portion.

6 Claims, 6 Drawing Sheets

BELLOWS PUMP

TECHNICAL FIELD

The present invention relates to a bellows pump which is suitable as liquid transporting means for pure water or medical solution and to be used in equipment or apparatus for producing a semiconductor or liquid crystal.

BACKGROUND ART

A bellows pump is configured by: a pump body which comprises a suction path and discharge path for a to-be-transported fluid; a bellows which is placed in a state where one end is airtightly fixed to the pump body to form a closed space with respect to the pump body; and an actuation plate which is attached to the other end of the bellows so as to cause the bellows to expand and contract with respect to the pump body. As examples of such a bellows pump, a single-bellows type disclosed in Patent Literature 1, and a double-bellows type (reciprocating pump) disclosed in Patent Literature 2 are known.

In a bellows pump which is a displacement pump, it is known that, in the timing of switching between suction due to the expansion of a bellows and discharge due to contraction of the bellows, a large pressure change (pressure rise) is momentarily produced. In the case where the fluid is liquid such as water, the change is shock vibration which is also called "water hammer". Vibration caused by the large pressure change is transmitted to an apparatus or a pipe, thereby producing a possibility that inconveniences such as that particles are generated, and that various portions are broken (for example: a quartz-made tank which is connected to the pump through a pipe cracks or breaks) may occur.

Conventionally, therefore, countermeasures that the flow rate in the pipe is reduced to suppress vibration, and that an accumulator or the like is added to absorb generated vibration, thereby relaxing vibration are taken. However, the former vibration suppressing means is in summary to reduce the discharge amount of the pump, and hence there is a disadvantage that the performance is lowered, and, in the case of the latter vibration relaxing means, problems such as that the installation place is made large, and that the cost is increased occur.

As described above, in the proposed countermeasures for suppressing or eliminating shock vibration which is generated because of the structure of a bellows pump in the timing of switching between suction and discharge, without causing performance reduction and increases of the installation place and the cost, there remains room for further improvement.

PRIOR ART LITERATURE

Patent Literature

Patent Literature 1: Japanese Patent Application Laid-Open No. 2001-123959

Patent Literature 2: Japanese Patent Application Laid-Open No. 2002-174180

SUMMARY OF THE INVENTION

Problem to be Solved by the Invention

It is an object of the invention to develop and provide a bellows pump which is further improved so that, without causing or while suppressing performance reduction and increases of the installation place and the cost, shock vibration which is generated in the timing of switching between suction and discharge can be suppressed or eliminated.

Means for Solving the Problem

The invention set forth in claim 1 is characterized in that a bellows pump has: a pump body 1 comprising a suction path 12 and discharge path 13 for a to-be-transported fluid; a bellows 2 which is placed in a state where one end 2*a* is airtightly fixed to the pump body 1 to form a closed space 11 with respect to the pump body 1; and an actuation plate 15 which is attached to another end 2*c* of the bellows 2 so as to cause the bellows 2 to expand and contract with respect to the pump body 1, wherein an airtight-like space portion 19 is formed between the other end 2*c* of the bellows 2 which is made of a fluorine resin, and the actuation plate 15, and a space-facing portion 20 which faces the space portion 19 in the other end 2*c* is elastically deformably configured so as to enable the space portion 19 to expand and contract.

The invention set forth in claim 2 is characterized in that, in the bellows pump according to claim 1, the other end 2*c* is formed into a plate-like portion in which a center portion is recessed so as to be opened toward the actuation plate, and which exhibits a substantially bottomed cylindrical shape, and a recessed portion in the other end 2*c* is configured as the space portion 19 by the actuation plate 15 in the other end 2*c* or sealing means 18 placed in an annular tip end face 17.

The invention set forth in claim 3 is characterized in that, in the bellows pump according to claim 1, the bellows pump is configured as a reciprocating pump in which the bellows 2 is airtightly fixed to each of end portions of the pump body 1, and the actuation plates 15 which are attached respectively to the bellows 2 are coupled to each other so that the pair of bellows 2, 2 that are opposed to each other complementarily expand and contract, by coupling rods 22 which are placed outside the bellows 2.

The invention set forth in claim 4 is characterized in that, in the bellows pump according to any one of claims 1 to 3, the bellows 2 is made of PTFE.

EFFECTS OF THE INVENTION

According to the invention of claim 1, although its detail will be described in the paragraph of embodiments, the space-facing portion which faces the space portion in the other end of the bellows is elastically deformable so that the airtight-like space portion formed between the other end of the bellows and the actuation plate can expand and contract. In the transmission (water hammer phenomenon) of vibration due to a pressure rise generated by sudden stop of the fluid, therefore, the internal capacity of the bellows is increased by elastic deformation of the space-facing portion synchronized with the generation of the pressure rise, to absorb the pressure rise, whereby the vibration can be reduced. This causes transmission of the vibration to other apparatuses to be reduced or avoided, and inconveniences such as that apparatuses are broken, and that particles are generated can be suppressed or eliminated. Moreover, it is not necessary to reduce the flow rate of the fluid, the original performance of the pump can be sufficiently provided, and an additional buffer apparatus is not required. As a result, it is possible to provide a bellows pump which is further improved so that, without causing or while suppressing performance reduction and increases of the installation place and the cost, shock vibration which is generated in the timing of switching between suction and discharge can be suppressed or eliminated. Furthermore, the bellows is made of a fluorine resin, and therefore a bellows pump can be provided that is suitable in, for example, a semiconductor washing step in which cleanness is required, or a medical solution supplying line in which high resistance to erosion is required.

According to the invention of claim 2, the recessed portion is disposed in the thick plate-like other bellows end, and the space portion is formed between the other end and the actuation plate. Therefore, there is an advantage that rational and economical means in which only a change of the bellows is requested and any other change is not necessary can attain the above-mentioned effects of the invention of claim 1. Moreover, the invention has another advantage that replacement of the bellows enables the bellows pump to be applied to an existing apparatus.

According to the invention of claim 3, it is possible to provide a bellows pump in which the structure is suitable for a high capacity pump, and shock vibration in a reciprocating pump in which also vibration tends to be large can be effectively suppressed or eliminated, and which has practical great advantages.

According to the invention of claim 4, PTFE is used as the fluorine resin, and the following effects can be attained. Although PTFE (polytetrafluoroethylene) is a general-purpose fluorine resin and a material which is relatively easily available, PTFE has excellent characteristics such as a wide working temperature range, a chemical resistance, an electrical insulation property, a low frictional property, a nonadhesive property, a weather resistance, and a fire retardancy, and is a material which is more suitable for a bellows pump.

BEST MODE FOR CARRYING OUT THE INVENTION

Figure 1:
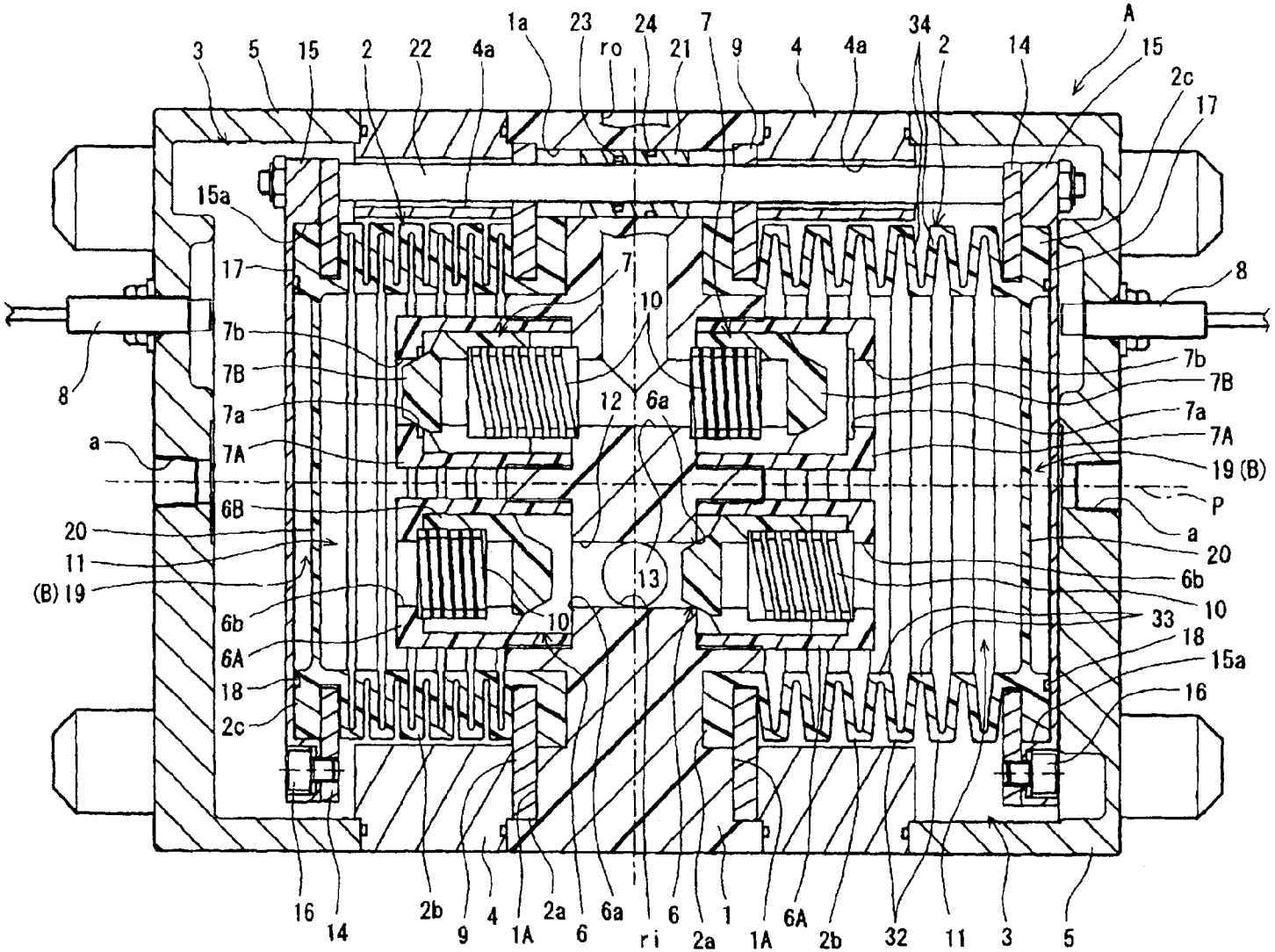
FIG. 1 is a sectional view showing the structure of a double-bellows pump (Embodiment 1).
Figure 3:
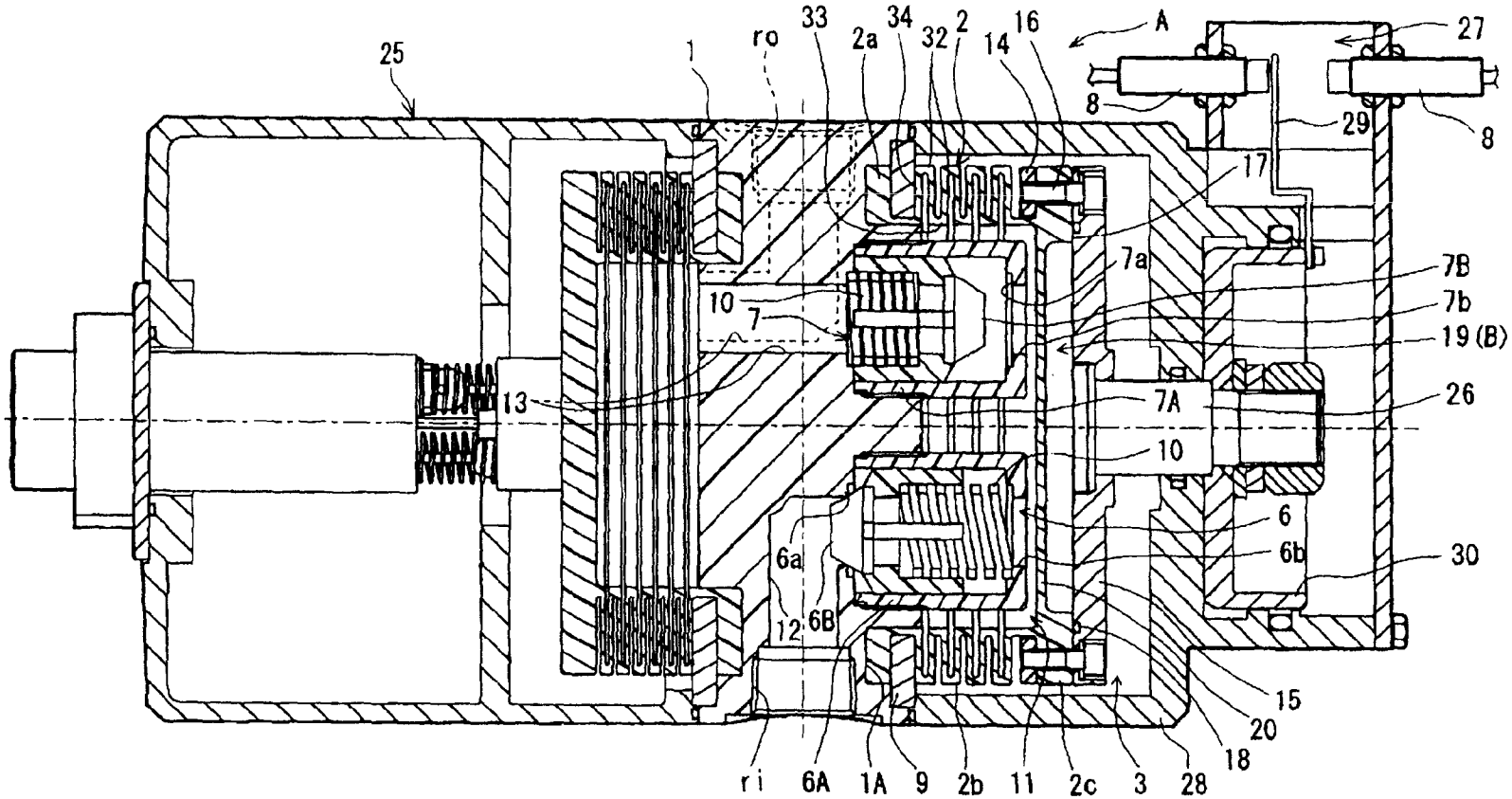
FIG. 3 is a sectional view showing the structure of a single-bellows pump (Embodiment 2).
Figure 4:
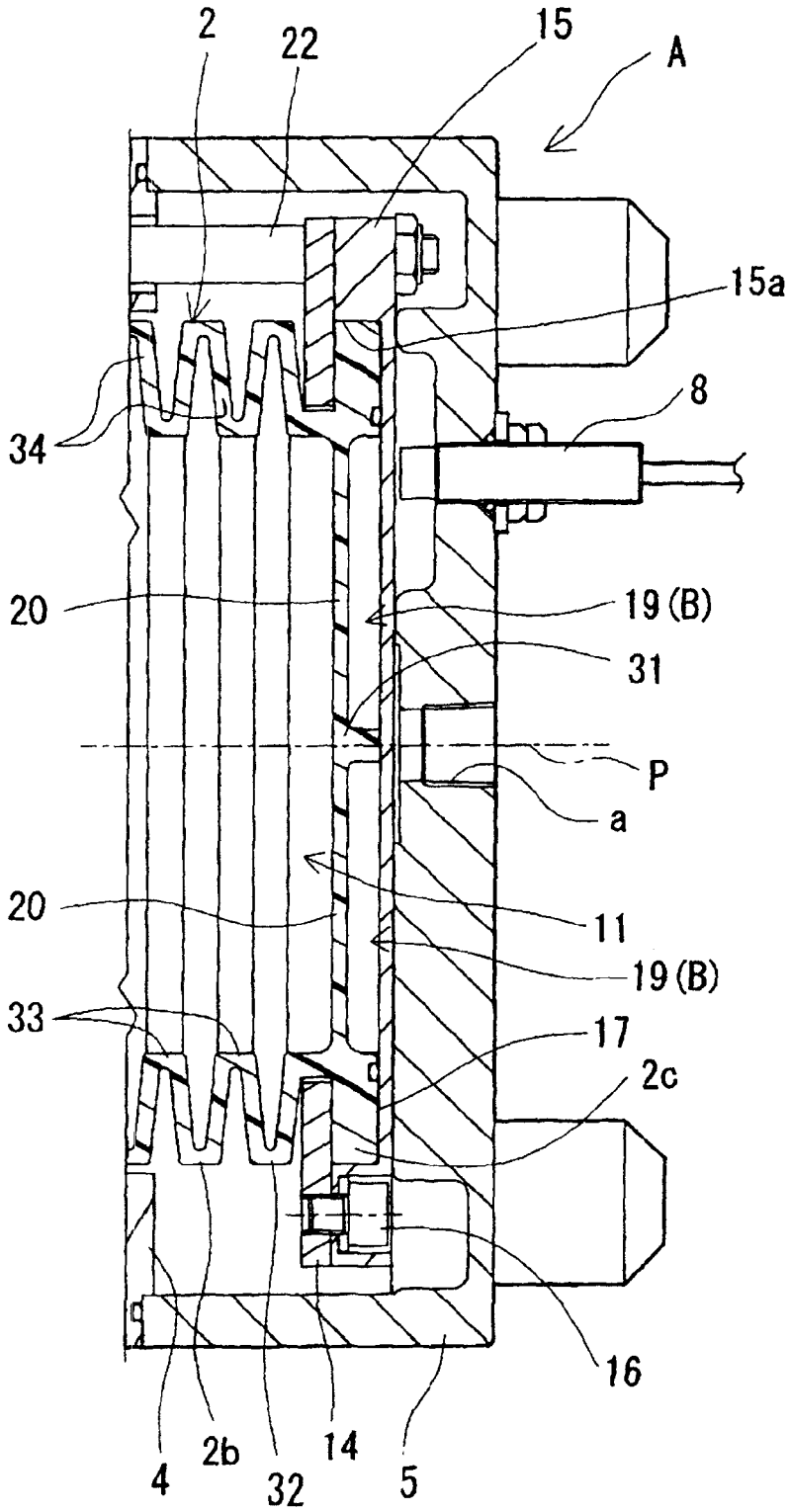
FIG. 4 is a principal view showing another structure of the shock buffering means.
Figure 5:
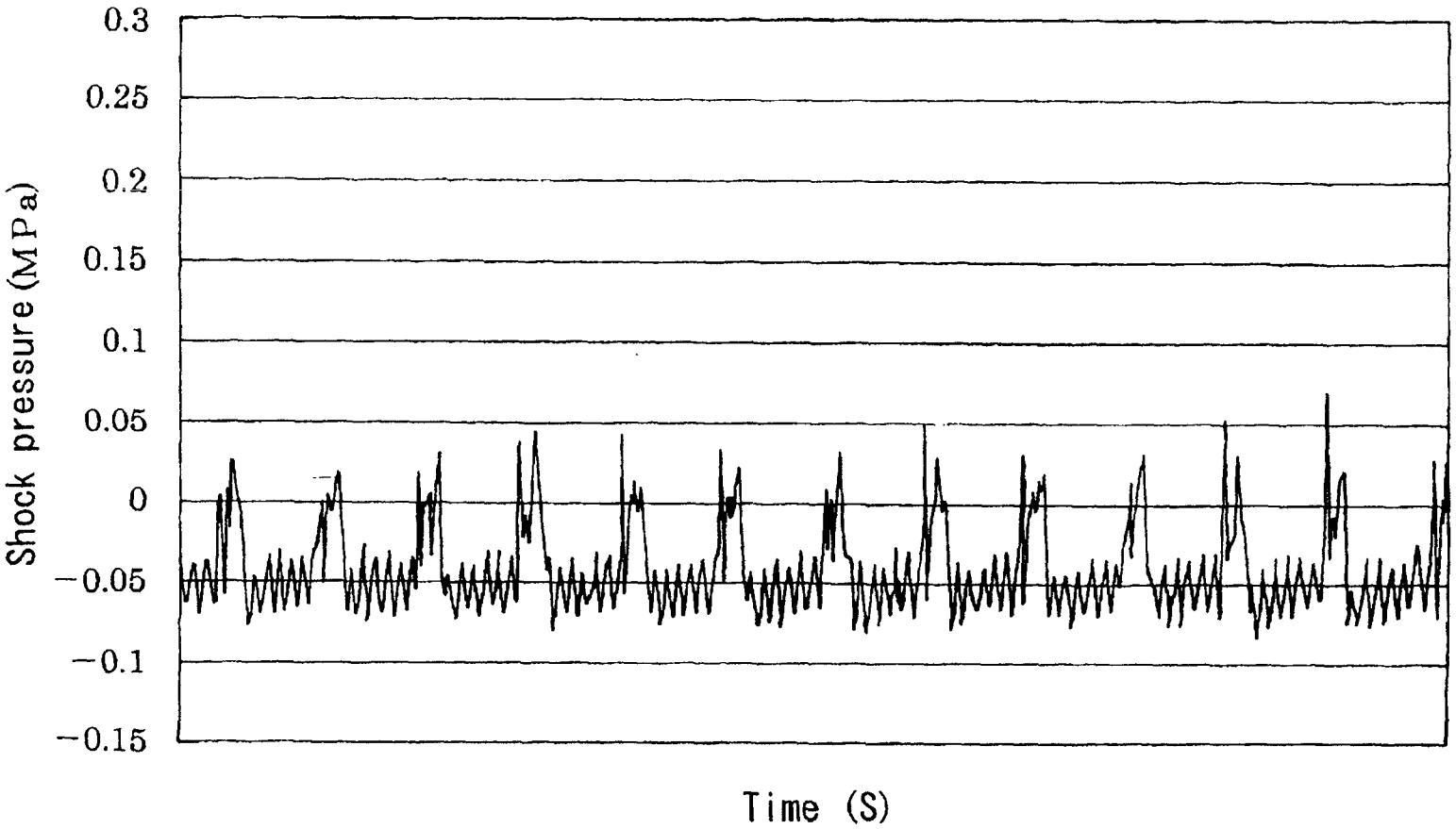
FIG. 5 is a view showing a relationship graph between the time and the shock pressure in a water hammer in the pump of the invention.
Figure 6:
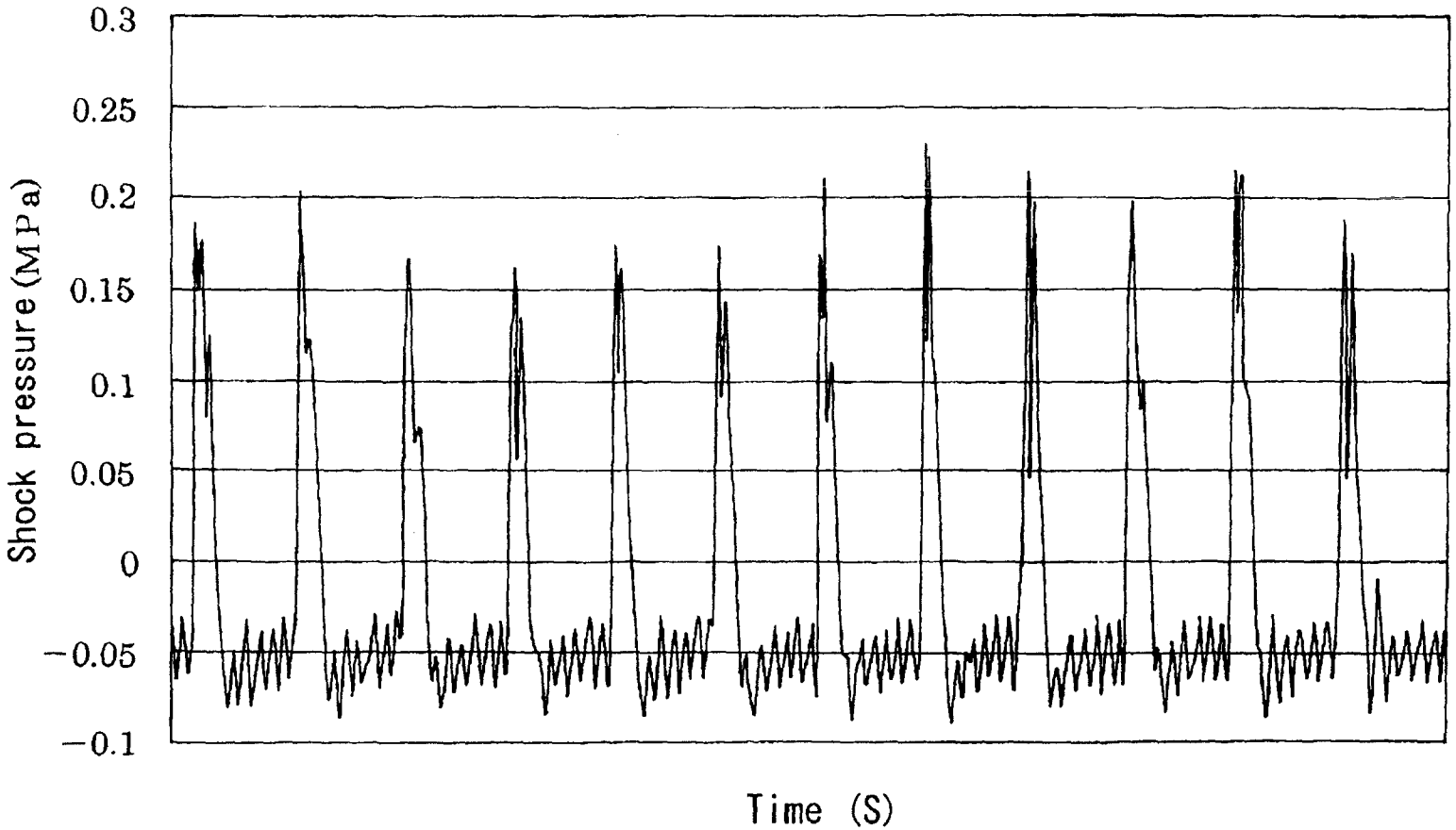
FIG. 6 is a view showing a relationship graph between the time and the shock pressure in a water hammer in a conventional pump.

Hereinafter, embodiments of the bellows pump of the invention will be described with reference to the drawings. FIG. 1 is a sectional view of a double-bellows pump of Embodiment 1, FIG. 2 is a partial view of shock buffering means, FIG. 3 is a sectional view of a single-bellows pump of Embodiment 2, FIG. 4 is a principal view of main portions showing another structure of the shock buffering means, FIG. 5 shows "time-shock pressure graph" caused by a water hammer in the pump of the invention, and FIG. 6 shows "time-shock pressure graph" caused by a water hammer in a conventional pump.

Embodiment 1

Figure 2:
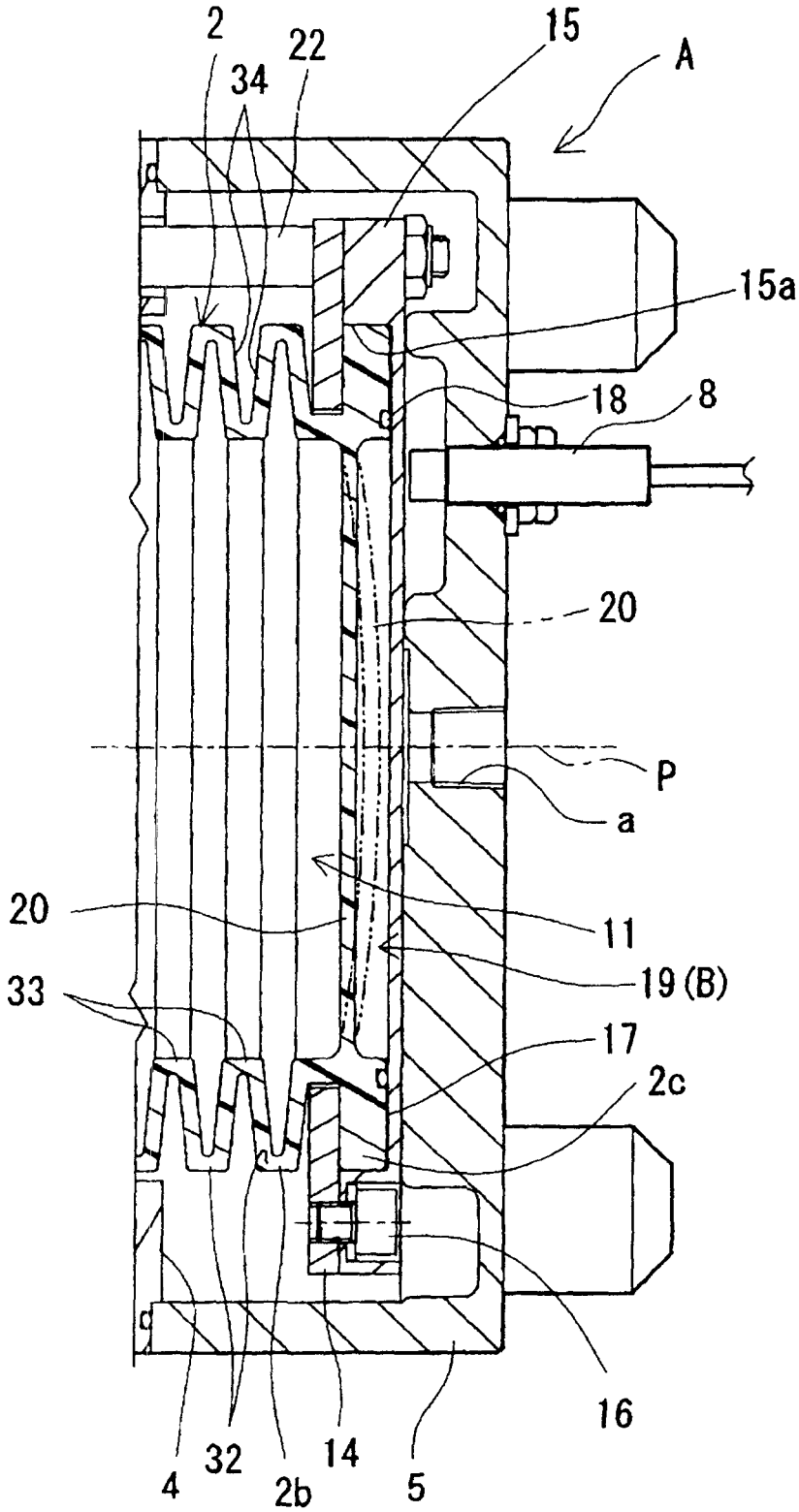
FIG. 2 is a sectional view of main portions showing the structure of shock interference means.

As shown in FIGS. 1 and 2, a bellows pump A of Embodiment 1 has a structure in which a pair of bellows are combined with each other in a back-to-back state, i.e., the double bellows type, and is a high capacity pump in which the discharge amount per unit time can be set large. The bellows pump A is configured by: a pump body 1 which is made of a fluorine resin (PTFE or the like), and which is in the laterally middle portion; a pair of bellows 2, 2 which are placed on the lateral sides (both end sides) of the pump body 1, which are made of a fluorine resin (PTFE or the like), and which have the common axis (pump axis) P; a pair of air cylinders 3, 3; a pair of intermediate cases 4, 4 which are formed continuously with the lateral sides of the pump body 1, and which are made of a stainless steel material (SUS304) or the like; a pair of end cases 5, 5 which are formed continuously with the lateral outer sides of the intermediate cases 4, 4, and which are made of a stainless steel material (SUS304) or the like; pairs of suction check valves 6, 6 and discharge check valves 7, 7; a pair of proximity sensors 8, 8; and the like.

Hereinafter, the pumping function will be briefly described. The air is complementarily introduced and discharged with respect to air supplying/discharging ports a, a which are disposed on the axis P of the end cases 5, 5, from an air supplying/discharging apparatus that is not shown, thereby causing the pair of air cylinders 3, 3 to complementarily expand and contract, so that a fluid such as medical solution which is sucked from a fluid sucking port ri that is placed in a side of the pump body 1 can be substantially continuously discharged from a fluid discharging port ro that is placed above the fluid sucking port. Namely, the pump has a structure where the pair of the bellows 2, 2 are complementarily expandingly and contractingly moved (expandingly and contractingly driven), and, during a period when one of the bellows 2 operates to discharge the fluid, the other bellows 2 operates to suck the fluid, so that, although having the reciprocating structure, the pump can continuously discharge the fluid.

Next, the structures of the portions will be described. As shown in FIG. 1, the pump body 1 is formed a flat and substantially columnar shape in which center portions of the lateral sides are outward projected. Thick flanges (an example of one end) 2*a* of the bellows 2 are fitted into stepped recess annular grooves 1A which are formed in lateral outer peripheral side portions of the pump body 1, and held in a slipping-off preventing manner through basal end side annular plates 9 which are clamped between the pump body 1 and the intermediate cases 4. A suction valve case 6A and a discharge valve case 7A are fittingly held by a pair of circular holes (reference numerals are omitted) which are formed in the center sides of the lateral sides of the pump body 1. Valve elements 6B, 7B, and coil springs 10 for pressingly urging the valve elements against valve seats 6*a*, 7*a* are incorporated in the respective valve cases 6A, 7A.

Circular holes 6*b*, 7*b* for passage of the fluid are formed in tip end portions of the valve cases 6A, 7A which are disposed in a state of projecting into pump chambers (an example of a closed space) 11 that are internal spaces of the bellows 2. In the pump body 1, a suction path 12 for communicating the pair of suction check valves 6, 6 with the fluid sucking port ri, and a discharge path 13 for communicating the pair of discharge check valves 7, 7 with the fluid discharging port ro are formed. In FIG. 1, the bellows 2 which is located on the right side is drawn in a state where the bellows is at the top dead center where the bellows maximally expands, and just begins to be contractingly moved, and the bellows 2 which is located on the left side is drawn in a state where the bellows is at the bottom dead center where the bellows maximally contracts, and just begins to be expandingly moved. Therefore, the discharge check valve 7 which is in the right side in FIG. 1, and the suction check valve 6 which is in the left side are drawn in a state where they are opened, and the discharge check valve 7 which is in the left side in FIG. 1, and the suction check valve 6 which is in the right side are drawn in a state where they are closed.

As shown in FIGS. 1 and 2, each of the bellows 2 has the above-described thick flange 2*a*, a bellow portion 2*b*, and a thick head portion (an example of "other end" and "plate-like portion") 2*c* which has a substantially circular shape. The actuation plate 15 is integrally attached to the head portion 2*c*. Namely, the head portion 2*c* is fitted into a center circular hole 15*a* formed in the actuation plate 15, and prevented from slipping off, by a tip-end side annular plate 14 which is placed on the side of the pump body, and which faces an outer peripheral portion of the head portion 2*c*, whereby the head portion is coupled to the actuation plate 15 so as to be moved integrally therewith. The tip-end side annular plate 14 is coupled to the actuation plate 15 by a plurality of bolts 16.

The head portion 2*c* is formed into a plate-like portion in which a center portion is recessed so as to be opened toward the actuation plate 15, and which exhibits a substantially bottomed cylindrical shape, and the recessed portion in the head portion 2*c* is configured as a space portion 19 by placing an O-ring (an example of sealing means) 18 on an annular tip end face 17 which is in contact with the actuation plate 15. In a structure where the head portion 2*c* is made of an elastic material such as rubber, sealing is performed simply by pressingly contacting the annular tip end face 17 with the actuation plate 15. In this case, the annular tip end face 17 itself functions as the sealing means. The existence of the space portion 19 which is a large-diameter hole causes the head portion 2*c* to be formed into a reduced-thickness portion (an example of a space-facing portion) 20 which has a small thickness, excluding its outer peripheral portion. Since the bellows 2 is made of a fluorine resin, preferably, PTFE, the reduced-thickness portion 20 can be elastically film-transferred. The bellows 2 may be formed by a material which is plastically and elastically deformable.

Namely, the airtight-like space portion 19 is formed between the head portion 2*c* of the bellows 2 and the actuation plate 15, and the reduced-thickness portion 20 which faces the space portion 19 in the head portion 2*c* is elastically deformably configured so as to enable the space portion 19 to expand and contract (expansion and contraction). The head portion 2*c* is formed into a plate-like portion in which a center portion is recessed so as to be opened toward the actuation plate 15, and which exhibits a substantially bottomed cylindrical shape, and it is configured as the space portion 19 in the head portion 2*c* by placing the O-ring 18 which is sealing means, on the annular tip end face 17 which is in the head portion 2*c*, and which is in contact with the actuation plate 15. Because of the existence of the space portion 19, shock buffering means (vibration relaxing means) B which suppresses and relaxes shock vibration (water hammer) generated in the timing of switching between suction and discharge (or discharge and suction) of the fluid is configured.

The bellows 2 is made of a fluorine resin, preferably, PTFE (polytetrafluoroethylene), and formed not by blow molding, but by performing a cutting process on a cylindrical member made of PTFE by a lathe with using a stick cutting tool, a knife, or the like. As shown in FIGS. 1 and 2, the bellows 2 has a bellows-like shape in which, in the bellow portion 2*b* that is located between the thick flange 2*a* and the head portion 2*c*, a crest portion 32 and a valley portion 33 are alternately disposed, and a disklike side face portion 34 is formed continuously between the crest portion 32 and the valley portion 33.

The thickness in the apex portion of the crest portion 32 and the deepest portion of the valley portion 33, i.e., the minimum thickness of the crest portion 32 and the valley portion 33 in the bellows diameter direction is set to be equal to the thickness of the side face portion 34 in the bellows axis direction. Preferably, the thickness may be set to be equal to or larger than it. More preferably, the inner peripheral face (the inner face of the bellows 2) of the crest portion 32, and the outer peripheral face (the outer face of the bellows 2) of the valley portion 33 may be configured by a curved face having a predetermined angle or a radius so that an acute portion is not produced. According to the configuration, when the bellows 2 expands in the axial direction, the side face portion 34 actively flexes, and, because of the flexure, stresses which are mainly generated in the inner face side of the curved face are dispersed in the minimum thickness portions of the crest portion 32 and the valley portion 33 or in the vicinities thereof, and stress concentration is relaxed.

Particularly, the ratio of the thickness of the side face portion 34 to the minimum thickness portions of the crest portion 32 and the valley portion 33 is preferably set to be in the range of 1.2 to 2.5. According to the configuration, even when the thicknesses of the crest portion 32 and the valley portion 33 are not wastefully made large, stress concentration in the portions can be effectively relaxed. When the minimum thickness of the crest portion 3 and the valley portion 33 is 1.4 mm and the thickness of the side face portion 34 is 3.0 mm, for example, the above-described ratio is about 2.1, and set to be in the adequate thickness range. When the ratio is smaller than 1.2, stress relaxation may be insufficient, and, when the ratio is larger than 2.5, the diameter of the bellows is increased so as to be contrary to the compactness.

The right and left actuation plates 15, 15 are loosely fitted into passing holes 4*a*, 4*a* of the intermediate cases 4, 4, movably passed through the basal end side annular plates 9, and screwingly fixed to the both ends of the coupling rods 22 which are passed in a liquid-tight state through a seal bearing 21 that is fitted into the pump body 1. The coupling rods 22 are disposed in a plural number (for example, four) at regular angular intervals about the axis P. The seal bearing 21 is pressingly inserted or fitted into a through hole la formed in the stepped recess annular grooves 1A, and inner and outer Orings 23, 24 are attached thereto. As described above, the right and left actuation plates 15, 15 are configured so as to be integrally moved in the direction of the axis P by the coupling rods 22, and the complementary expansion and contraction of the pair of the bellows 2, 2 can be surely performed.

Next, the function and effect of the shock buffering means B will be described. Usually, when a fluid suction check valve and fluid discharge check valve which are incorporated in a bellows pump are switched, or when various valves which exist in a piping system, such as an opening/closing valve, a stop valve, and a check valve are switched, a valve element butts against (or separates from) a valve seat, and therefore an abrupt pressure rise due to sudden acceleration or deceleration of a fluid is generated, thereby producing a disadvantage that shock vibration is generated in the piping system. In the bellows pump A of the invention, there is an advantage that generation of such shock vibration is relaxed or eliminated by the shock buffering means B which is disposed in the head portion 2*c* by using the actuation plate 15.

The water hammer will be described in a further detail. In the case where one of the bellows expands and the fluid enters the bellows through the fluid suction check valve which is incorporated in the bellows pump, even when the expansion movement of the bellows is stopped, the fluid is caused by inertia to try to still enter the bellows through the fluid suction check valve, and hence the pressure in the bellows temporarily abruptly rises. Then, the fluid suction check valve is suddenly closed (suddenly interrupted), and, at this time, the fluid which tries to enter the bellows through the fluid suction path is abruptly interrupted, thereby producing a water hammer. Shock and vibration due to by the water hammer transmit through the piping, and cause a damage such as a crack to be produced in a quartz-made tank or the like. Basically, a water hammer is produced by suddenly closing a check valve. When an abrupt pressure rise in a bellows which causes sudden valve closing is absorbed so that sudden valve closing does not occur, it is possible to prevent a water hammer from being generated. As an example of means for the purpose, it may be contemplated that the expansion/contraction moving rate (stroke speed) of a bellows is reduced to prevent sudden valve closing from occurring. In this case, however, the flow amount cannot be ensured, with the result that it is difficult to realize the above. According to the means in which the reduced-thickness portion 20 is disposed in the head portion 2*c* as in the invention, the elastic deformation of the reduced-thickness portion 20 absorbs an abrupt pressure rise in the bellows, and a water hammer can be avoided or reduced. Moreover, an excellent effect that it is not necessary to reduce the expansion/contraction moving rate of the bellows and a predetermined flow amount can be ensured can be realized.

When a large pressure rise occurs, namely, the space portion 19 functions as an air bag and the reduced-thickness portion 20 is elastically deformed in the direction along which the capacity is reduced, as indicated by the phantom lines in FIG. 2, and the shock buffering means B functions so that the pressure rise in the bellows is instantly cancelled or largely reduced. The reduced-thickness portion 20 is designed to have sufficient strength so as not to be substantially deformed by the discharge pressure of the pump (more correctly, a thickness at which a flexure is slightly produced but permanent distortion does not occur). A conventional head portion has a mere thick plate like shape in which the space portion 19 is not disposed. By reducing the thickness thereof, the space portion 19 is disposed between the head portion and the actuation plate 15 so as to function as the shock buffering means B. Therefore, an economical and rational countermeasure in which addition of a new component, reconstruction, and a dedicated installation space are entirely unnecessary is successfully realized. Replacement of the bellows 2 enables the bellows pump to be applied to an existing apparatus. Therefore, the bellows pump is an excellent pump which is highly versatile.

In the transmission of vibration or so-called the water hammer phenomenon due to a pressure rise generated by sudden stop of the fluid (kinetic energy), the internal capacity of the bellows is increased by elastic deformation of the reduced-thickness portion 20 synchronized with the generation of the pressure rise, to absorb the pressure rise, whereby the vibration can be reduced. This causes transmission of the vibration to other apparatuses to be reduced (or avoided), and inconveniences such as that apparatuses are broken, and that particles are generated can be suppressed (or eliminated). Moreover, since it is not necessary to reduce the flow rate of the fluid, the original performance of the pump can be sufficiently provided, and an additional buffer apparatus is not required. Also an effect that the footprint and the cost are reduced can be expected.

FIGS. 5 and 6 show test data of a water hammer in the bellows pump of the invention and a conventional bellows pump, for reference. From "time-shock pressure graph" (a relationship graph between the elapse of time and the degree of a water hammer in accordance with this, i.e., the shock pressure) in the conventional bellows pump shown in FIG. 6, it is known that the absolute value (average) of the shock pressure is about 0.25 Mpa. From "time-shock pressure graph" in the bellows pump of the invention shown in FIG. 5, by contrast, it is understood that the absolute value (average) of the shock pressure is about 0.075 Mpa, and only 30% of the conventional value. In other words, when the invention is employed, a very large effect that the water shock pressure is reduced by 70% as compared with the conventional bellows pump is attained.

Embodiment 2

As shown in FIG. 3, a bellows pump A of Embodiment 2 is an example where the invention is applied to a single-bellows type pump in which the bellows 2 is disposed in only one side of the pump body 1. In the single-bellows type bellows pump A, a pulsation reducing mechanism 25 is disposed in the other end of the pump body 1 in which the bellows 2 is placed in one end, and the actuation plate 15 is provided with: a pump shaft 26 which is fixed to the actuation plate 15 in order to allow the bellows 2 to expand and contract; a position detecting mechanism 27 which uses the pump shaft 26, the pair of proximity sensors 8, 8; and the like. The shock buffering means B itself in the bellows pump A of Embodiment 2 is identical with that of the bellows pump A of Embodiment 1.

In FIG. 3, 28 denotes a pump casing which is attached to the pump body 1, and 29 denotes a sensing piece which is attached to the pump shaft 26 through a movement flange 30 so as to be integrally movable. The head portion 2*c* is structured so that the head portion is clamped between the tip-end side annular plate 14 and the actuation plate 15 by bolts 16 which are passed through the head portion, and, because of its configuration, movable integrally with the actuation plate 15. The portions having the same function as those of the pump of Embodiment 1 are denoted by the identical reference numerals, and it is assumed that their description has been made.

First Other Embodiment

As shown in FIG. 4, the shock buffering means B may have a structure having the head portion 2*c* in which the space portion 19 facing the actuation plate is formed in a plurality of places by, for example, disposing a striplike rib 31 that reaches from the reduced-thickness portion 20 to the actuation plate 15. When one rib which radially traverses the columnar space portion shown in FIGS. 1 and 2 while passing through the axis P is formed, for example, two space portions 19 which are semicircular as viewed in the axial direction are formed, and, when two ribs which intersect with each other are formed, four space portions 19 which are quadrantal as viewed in the axial direction are formed. According to the configuration, the spring constant of the space portion 19 functioning as an air bag can be changed. Although not illustrated, shock buffering means B may be configured so that the shock buffering means has a space portion 19 which is configured by a recessed portion formed in a thick actuation plate 15.

Second Other Embodiment

Although not illustrated also, the shock buffering means B may be configured so that a spherical member which can perform only elastic contraction is placed inside the bellows 2. For example, the spherical member may be an air-filled rubber ball in which the outside is covered by a woven metal wire mesh, and, when a large pressure rise such as a water hammer occurs, the rubber ball contracts to absorb and relax the pressure. Even when a negative pressure acts, the ball does not expand beyond the size which is defined by the woven metal wire mesh. Therefore, this is convenient.

DESCRIPTION OF REFERENCE NUMERALS

1 pump body
2 bellows
2*a* one end
2*c* other end
12 suction path
13 discharge path
15 actuation plate
17 annular tip end face
18 sealing means
19 space portion
20 space-facing portion
22 coupling rod

The invention claimed is:

1. A bellows pump having: a pump body comprising a suction path and a discharge path for a to-be-transported fluid; a bellows which is placed in a state where one end is airtightly fixed to said pump body to form a closed space with respect to said pump body; and an actuation plate which is attached to an other end of said bellows so as to cause said bellows to expand and contract with respect to said pump body, wherein said bellows is integrally formed as a single piece with said other end, a thickness of a peripheral portion of said other end of said bellows is larger than a thickness of a center portion of said other end of said bellows, the peripheral portion of said other end of said bellows is in contact with the actuation plate, the center portion of said other end of said bellows forms a recessed portion within said other end of said bellows and an airtight chamber portion is formed in the recessed portion and among the peripheral portion of said other end of said bellows, the center portion of said other end of said bellows, and the actuation plate, the bellows being made of a fluorine resin, and the center portion of said other end of said bellows is elastically deformably configured so as to enable said airtight chamber portion to expand and contract.

2. A bellows pump according to claim 1, further comprising sealing means placed between the peripheral portion of said other end of said bellows and the actuation plate to form the airtight chamber portion.

3. A bellows pump according to claim 2, wherein said bellows is made of polytetrafluoroethylene (PTFE).

4. A bellows pump according to claim 1, wherein said bellows pump is configured as a reciprocating pump in which a pair of said bellows are airtightly fixed to each of end portions of said pump body, and actuation plates are attached respectively to each of said bellows so that said pair of said bellows are opposed to each other so as to complementarily expand and contract and are coupled to each other by coupling rods which are placed outside said bellows.

5. A bellows pump according to claim 4, wherein said pair of said bellows is made of polytetrafluoroethylene (PTFE).

6. A bellows pump according to claim 1, wherein said bellows is made of polytetrafluoroethylene (PTFE).

* * * * *